US005875495A

United States Patent [19]

Thrower

[11] Patent Number: 5,875,495

[45] Date of Patent: Mar. 2, 1999

[54] MALE UNDERGARMENT

[76] Inventor: John H. Thrower, 1231 Belrose La., Charlotte, N.C. 28209

[21] Appl. No.: 946,235

[22] Filed: Oct. 7, 1997

[51] Int. Cl.[6] ..... A41B 9/02

[52] U.S. Cl. ..... 2/403; 2/400; 2/236; 2/237

[58] Field of Search ..... 2/400, 220, 221, 2/403, 236, 405, 238, 227, 228, 237, 2; 602/67, 68, 69, 70, 71, 73; 66/177, 172

[56] References Cited

U.S. PATENT DOCUMENTS

| | | | |
|---|---|---|---|
| 3,016,726 | 1/1962 | Lawson | 66/177 |
| 4,759,355 | 7/1988 | Thrower | 2/405 X |
| 4,875,241 | 10/1989 | Browder, Jr. et al. | 2/409 |
| 5,283,912 | 2/1994 | Chung | 2/403 |
| 5,647,065 | 7/1997 | Richerson | 2/403 |

FOREIGN PATENT DOCUMENTS

| | | | |
|---|---|---|---|
| 92/018021 | 10/1992 | WIPO | 2/403 |

*Primary Examiner*—Gloria M. Hale

[57] ABSTRACT

A male undergarment formed from a tubular body portion having a scrotum-underlying section with an oval opening defined therein and an outer genitalia-concealing panel connected to a crotch section of the tubular body portion and extending along the leg openings and up to the waistband, thereby forming a pocket with the front area of the tubular body portion along the waistband. The defined opening receives the complete genitalia to be encased by the pocket.

9 Claims, 3 Drawing Sheets

MALE UNDERGARMENT

BACKGROUND OF THE INVENTION

This invention relates to wearing apparel and more particularly to a male undergarment generally referred to as a brief which gives the comfort of a snug fit yet permits free movement of the portions of the body adjacent thereto. For many years, there have been relatively few undergarment configurations developed which strive to provide the wearer with a greater degree of comfort and accessibility than that normally experienced in conventional garments. Examples of such configurations are undergarments which are intended to provide support when the wearer is in a sitting position, flap coverings over penis openings, and those undergarments intended for use by men suffering from various ailments such as kidney, bowel, bladder, or prostate disorders. The garments developed in the past have attempted to provide relief to the wearer in the area of health protection; however, they have not adequately provided means for gently supporting the genitals while simultaneously separating and encasing the adjacent skin surfaces and providing a layer of fabric as an aid to perspiration control, thereby protecting the wearer from the effects of the disorders of heat rash and/or herpes or the reduced sperm count which is experienced by some 30% of males as a result of increased scrotal temperature caused by the average snug brief compressing the scrotal sac so closely to the body.

Some prior art undergarments have attempted to solve the health-related problem concerning proper air circulation to the genitals of the wearer; however, the majority, for the most part, inhibit air circulation.

BRIEF SUMMARY OF THE INVENTION

In its basic form, the present invention includes a tubular body portion having front, back, and crotch areas and a pair of leg-receiving openings with the front area in which a defined oval opening receives the complete male genitals. A waistband is secured to the upper edge of the tubular body portion, and an outer genital-covering panel is secured at one end to the crotch of the tubular body portion and then extends upwardly along the leg openings to the sides and then upwardly therefrom to the waistband, thus forming a pocket between the front panel and the outer covering panel. The panel can be formed of a combination of elastomeric and other yarns such as cotton to provide additional support. The upper edge of the outer genital-covering panel is trimmed with a stretchable element that will retain that edge against the waistband in a normal position but will stretch out and down to disclose the pocket between the front area of the tubular body portion and the genital-covering panel when it is displaced downwardly and away from the waistband by the wearer.

OBJECTIVES OF THE INVENTION

Essentially it is the primary object of this invention to provide a male undergarment having a construction that will support separately the male genitals, provide a high degree of comfort to the wearer, and provide protection to the body area covered by the garment by preventing excess heat and excess perspiration commonly experienced in this area of the body.

It is another objective of the present invention to provide a male undergarment which both covers and supports a wearer's genitals while allowing air circulation thereto.

Another objective of the present invention is to provide a male undergarment that will maintain the testicles at a cooler temperature needed for greater sperm production by removing the normal close-to-body compressive contact experienced when using conventional garments.

It is yet another objective of the present invention to provide an undergarment which simultaneously provides health protection, support, comfort, and privacy without a radical departure from the customary appearance of a brief.

Yet still another objective of the present invention is to provide a genital-receiving pocket between two contiguous panels which is accessible through an opening lying along and adjacent the waistband.

Yet another objective of the present invention is to provide a male undergarment in a variety of sizes and styles adaptable to fit differently sized wearers which is easy to don and remove, provide a high degree of comfort and support for the male genitals and allow maximum free body movement, the brief being simple in construction and requiring a minimum number of stitching operations during fabrication. It is particularly effective and comfortable in the bikini style having the upper border in the area of the hip, but is also readily adaptable to the more full-cut style of the waist-high brief.

Yet still another further objective of the present invention is to provide a male undergarment of the type described which, in one embodiment, includes a front cover panel formed from a combination of elastomeric and cotton yarns to provide additional support for wearers who exercise or participate in athletic events.

These, together with other objectives and advantages, will become more apparent after consideration of the following detailed description of the present invention taken in conjunction with the accompanying drawings wherein like characters of reference designate like parts throughout the several views.

DETAILED DESCRIPTION OF THE INVENTION

Figure 3:
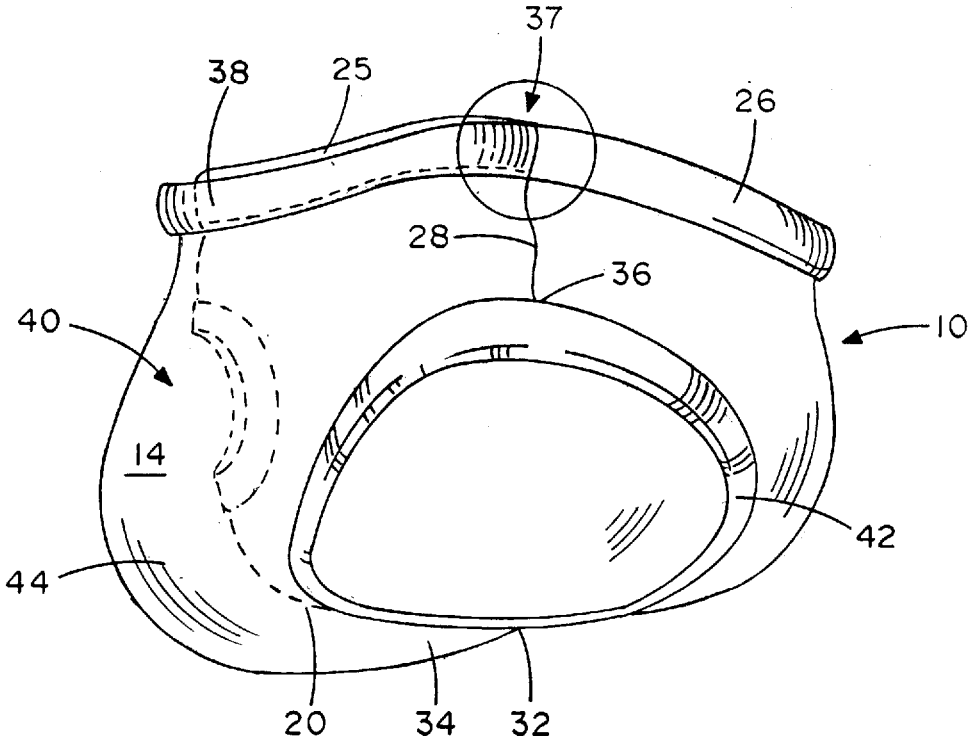
FIG. 3 is a side elevational view of the tubular body portion shown in FIGS. 1 and 2 and the attached genital-covering panel which forms with the front area of the tubular body portion an accessible pocket.

FIG. 3 displays a male undergarment shown generally as 10 which is formed of two basic elements. The first element is a tubular body portion shown generally as 12 in FIG. 1, and the second element is a genital-covering panel shown generally as 14 in FIG. 3. Tubular body portion 12 has a front area 16, a back area 18, and a crotch area 20. Front area 16 has a scrotum underlying section 22 at its lower edge and a vertical oval opening 24 defined therein. The upper front and back perimeter of tubular body portion 12 is provided with stretchable means by the attachment of a waistband 25, 26 to encircle securely the waist (or hip, if bikini) of the wearer and hold the garment in a relatively fixed position during use. Tubular body portion 12 can be knit on a circular knitting machine having a selected cylinder diameter and may thereby result in a seamless tubular member snugly encircling the torso of the wearer. Such garments are made in varying sizes, by reducing or enlarging the diameter of the seamless tube through the use of knitting cylinders of different diameter. Tubular body portion 12 might also be formed from two or more patterns cut for a front area 16 and a back area 18 with seams at 28, such as shown in FIG. 1.

Figure 1:
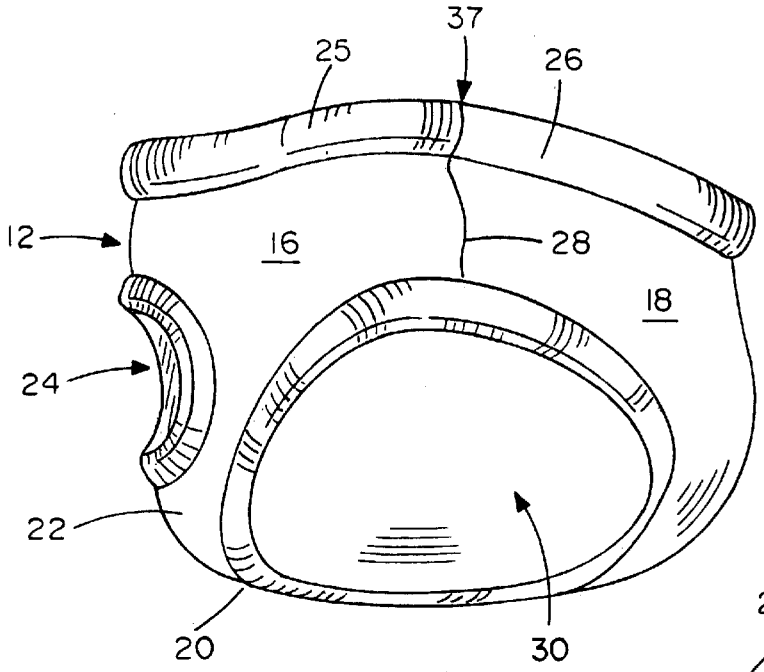
FIG. 1 is a side elevational view of the tubular body portion of the present invention illustrating the genital-receiving opening, waistband, and one of the two leg bands.

Tubular body portion 12 also includes a pair of leg-receiving openings 30 and is patterned while in a generally tubular condition to provide for the formation of the crotch area 20 as shown in FIG. 1 using a single seam 32.

Undergarment 10 is completed by affixing an outer genital-covering panel 14 to the tubular body portion 12 in the manner best shown in FIG. 3. The outer covering panel is shaped to substantially configure with leg openings 30 and waist band 25 of front area 16 of tubular body portion 12 as is shown in FIG. 3. Genital-covering panel 14 is secured to crotch area 20 of tubular body portion 12 at location 34 which preferably coincides with and becomes a part of seam 32. The leg bordering edges of genital-covering panel 14 are then caused to lie along the front edges of leg openings 30 to location 36 which is between the front and back areas 16 and 18 of tubular body portion 12 and would be on the side seam 28 if cut from patterns for front and back. If there is a seam 28 in tubular body portion 12, the genital-covering panel becomes connected to the tubular body portion within that seam. The connection continues upwardly to and through waistband 25, 26 at junction line 37.

The upper edge of genital-covering panel portion 14 is attached to a partial waistband 38, matching that portion used in waistband 26 along the upper edge of back area 18, so that while being worn it is held in a substantially contiguous relationship with waistband 25 along the upper edge of front area 16 of tubular body portion 12. Thus the securement of genital-covering panel 14 to tubular body portion 12 at seam 34, along leg openings 30, and upwardly along seam 28 forms a pocket 40 between tubular body portion 12 and genital-covering panel 14. Since partial waistband 38 is not secured to waistband 25 other than at junction 37, the pocket is accessible generally through the upper front area of the garment.

The securement of the genital-covering panel 14 to tubular body portion 12 along leg openings 30 is best accomplished by the use of leg bands 42 which are comprised of strips of stretchable fabric folded over the joined edges of tubular body portion 12 and genital-covering panel 14. Each of the bands 42 encircles an entire leg opening 30. A similar stretchable banding technique is used around oval opening 24 which prevents unravelling of the fabric around the defined opening. The unraveling of the edge of defined opening 24 in certain fabrics may be adequately prevented by serging the cut edge. Oval opening 24 with its wider portion being vertical has been found to be far more practicable and useful than any other opening configuration.

Figure 4:
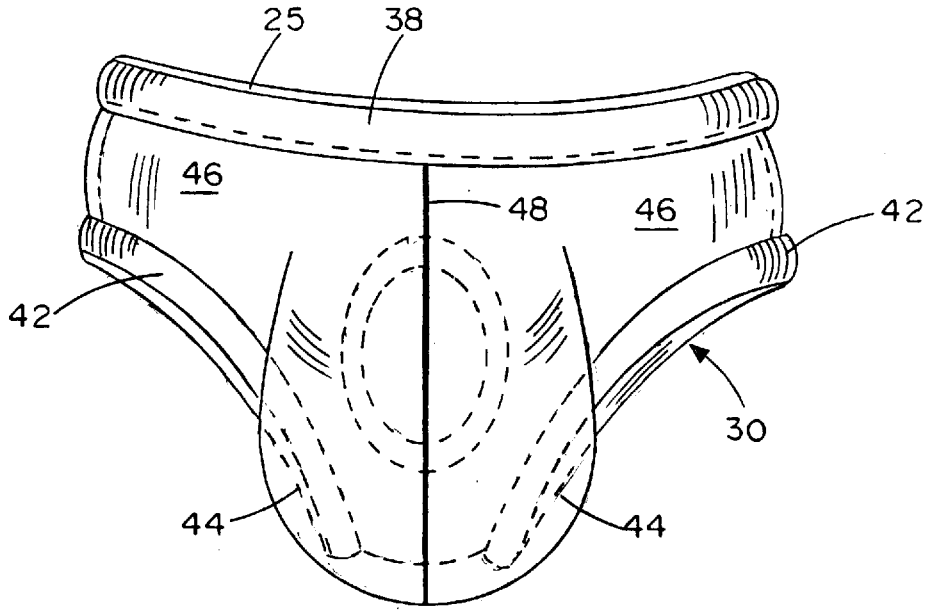
FIG. 4 is a front elevational view of the garment shown in FIG. 3 illustrating the use of two substantially similar sections joined to form the genital-covering panel.

It has been found desirable to provide a convex pouch portion 44 in genital-covering panel 14 to ensure freedom of movement and air circulation within pocket 40. This may be accomplished by molding the fabric to create a pouch or if using knit fabric by varying the stitch sizes to produce a proper amount of fullness or utilizing two or more fabric segments to form the desired convexity. It has been found advantageous to utilize two substantially similar pieces 46 joined by a vertical seam 48 along the front of the garment as shown in FIG. 4. Obviously, any number of segments can be configured to achieve the desired convexity in such a construction.

In knitting the undergarment comprising the present invention, it may be desirable to knit the pouch portion 44 and genital covering panel 14 with somewhat heavy elastomeric yarns, at least in part, in order to provide a comfortable measure of support. For example, it has been found advantageous to produce one style of the garment having 92% of the panel 14 formed of 30/1 polyester jersey knit material with about 8% of the panel containing additional laid-in 40 denier elastomeric yarn such as spandex. For varying support conditions desired, a range of 30/1 can vary with more laid-in spandex included to achieve greater support. For example, about 80% of the panel 14 can be formed of 30/1 cotton yarn with about 12% of up to 70 denier Spandex yarn being laid-in to give that requisite support. The non-support version of the garment selected for regular daily usage, is best formed from 30/1 cotton yarn in a plain knit configuration.

In developing the knitted structure of panel 14 with a combination of cotton or polyester and elastomeric yarns, the fabric can be formed by a knitted structure having a plurality of successive courses knitted from cotton or polyester yarn and a bare elastomeric yarn laid in preferably on every course, or alternatively, on alternate courses. Such a knitted structure is shown in FIG. 9 wherein the fabric is formed by a plurality of successive courses 50 with a bare elastomeric yarn 52 laid in on every course 50.

Figure 9:
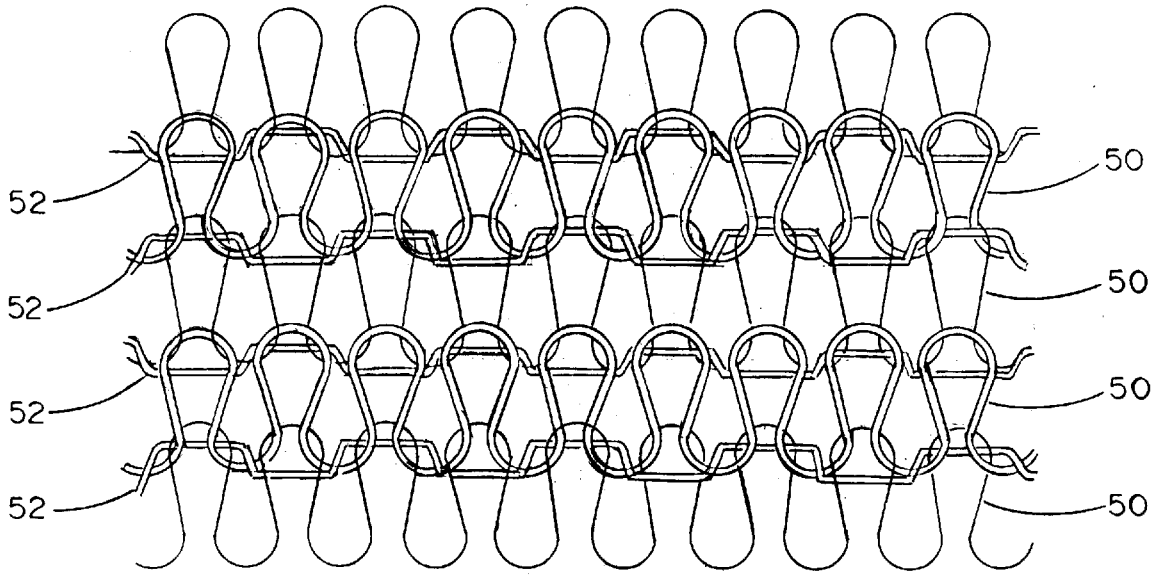
FIG. 9 is a greatly enlarged fragmented view of the knit structure of the fabric forming the genital-covering panel of the present invention.
Figure 7:
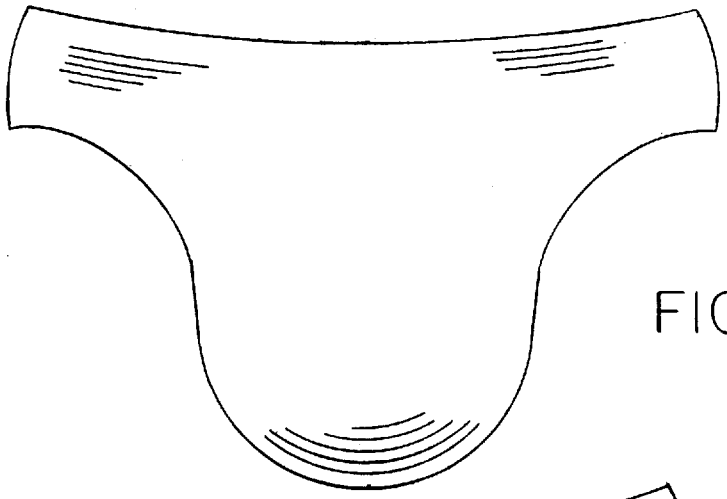
FIG. 7 is a front elevational view of the outer genital-covering panel formed from a single piece of knit fabric.
Figure 8:
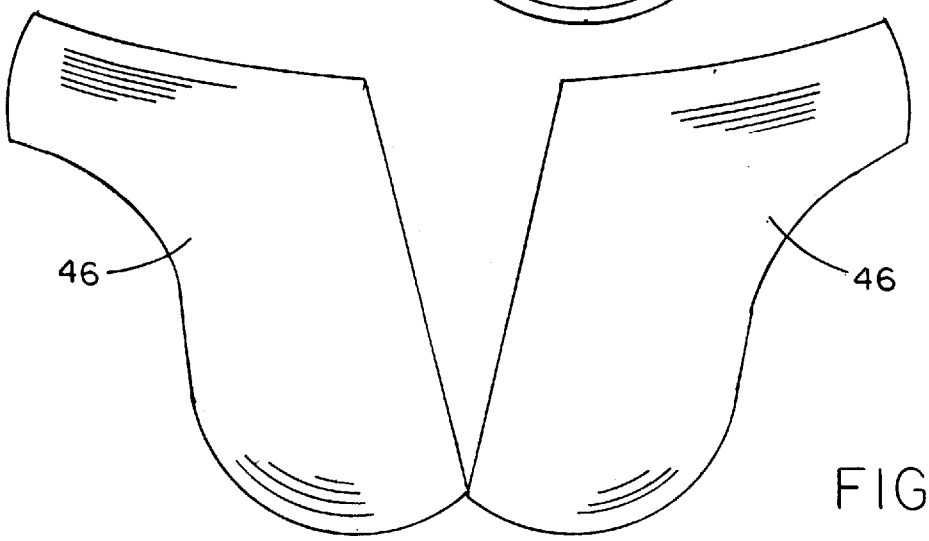
FIG. 8 is a front elevational view of the outer genital-covering panel formed from two separate pieces of knit fabric prior to their being joined together.

An alternate knitted structure would involve laying in the elastomeric yarn 52 on alternate courses rather than every course as shown in FIG. 9.

In both examples, the successive courses 50 define a plain jersey knit structure although other alternative knit structures can be used effectively.

The undergarment of the present invention as described and illustrated will provide greater comfort by moisture absorption and air circulation than conventional forms of briefs now being marketed. The garment minimizes binding, pinching and especially chafing, and at the same time provides anatomically correct freedom for the male genitals as experienced in boxer shorts, but with the additional concealment (modesty) over and beyond that provided by customary briefs, as this invention will total encase the male genitalia in a pocket preventing the occasional unexpected exposure when wearing a brief under sports garments with short legs. The penis and scrotum which extend through opening 24 are free and not subject to any constriction or binding and are fully covered and protected within pocket 40. Access to the penis may be obtained by simply lifting or moving the partial band 38 downwardly. The retractability of partial band 38 will cause the outer genital-covering panel to return to its initial covering and support position.

The garment of the present invention provides a man's unique brief that assists the testicles in maintaining the cooler temperatures needed for greater sperm production by removing the close-to-body compressive contact experienced in normal knit briefs, as well as providing a moisture absorbing fabric entirely surrounding the scrotum to allow air circulation and promote cooling.

The garment of the present invention may also be made entirely of a light mesh knit or woven fabric or parts of the garment may be of knit fabric and other parts of woven fabric. The brief may also be made in a variety of sizes resulting from variations in the sizes of the various elements including the tubular support body portion 12, the genital-covering panel 14, and the defined opening 24.

Figure 5:
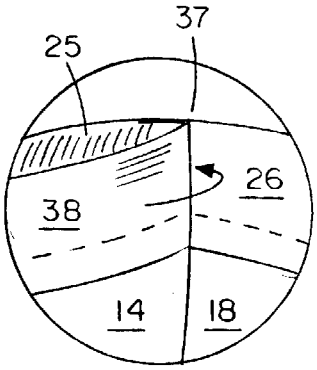
FIG. 5 is an enlarged view of the encircled area shown in FIG. 3, illustrating the attachment of the partial waistband of the outer genital-covering panel to the waistband of the tubular body portion with the partial waistband terminal end connected to the tubular body portion waistband in the forwardly condition.
Figure 2:
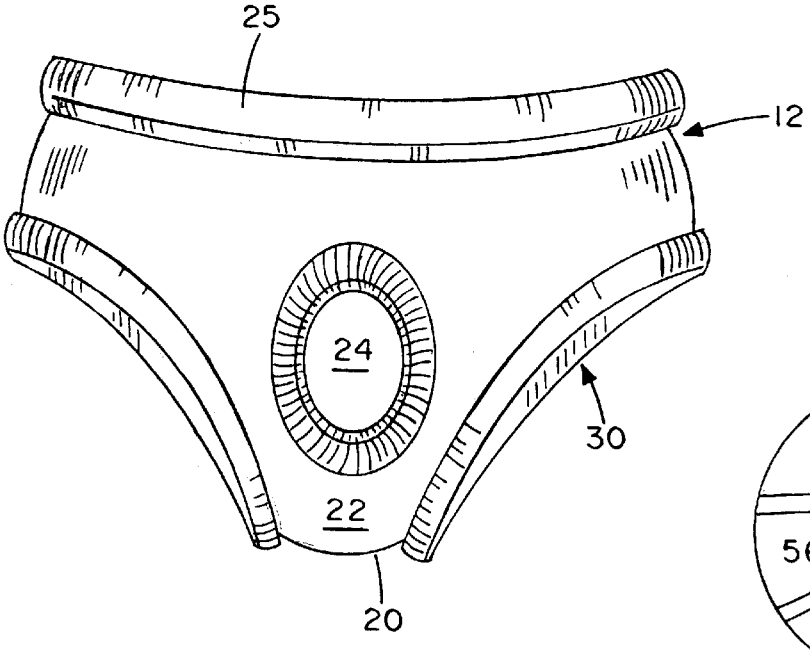
FIG. 2 is a front elevational view of the tubular portion shown in FIG. 1 illustrating both leg bands, one encircling each of the leg openings of the tubular body portion.
Figure 6:
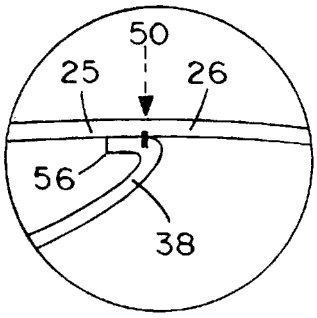
FIG. 6 is a plan and enlarged view of FIG. 5 and the encircled area shown in FIG. 3.

The particulars of the method by which partial waistband 38 on the upper edge of genital-covering panel 14 is attached to waistband 25, 26 of tubular body portion 12 are illustrated in FIGS. 5 and 6. Partial waistband 38 is sewn at junction 37 where bands 25, 26 are joined so that a seam 50 (FIG. 6) is formed. Partial waistband 38 is sewn flat against waistband 25–26 while extended toward the rear portion 18 of the garment, but is then turned back toward the front of the garment to form pouch portion 44. Thus the partial waistband terminal end 56 is sewn to waistband 25, 26 so that it extends forwardly or toward the front of garment 10. Attaching partial waistband 38 in this manner gives additional strength and facilitates the use of pocket 40 by the wearer.

It has been found advantageous to configure the opening 24 as a vertical oval, since this configuration spreads comfortably and appropriately when the garment is donned and worn.

As this invention may be reflected in several forms without departing from its essential characteristics, the present embodiment is, therefore, illustrative and not restrictive, the scope of the invention being defined by the appended claims rather than by the description preceding them. All modifications to the present embodiment that fall within the metes and bounds of these claims or result in alternative embodiments or their functional and cooperative equivalents are intended to be embraced by these claims.

What is claimed is:

1. A male undergarment comprising: a tubular body-encasing portion having front, back and crotch areas, a front waistband secured to the front area, a back waistband secured to the back area, and a pair of leg-receiving openings, the front area having a scrotum-underlying section and a vertical oval opening; an outer front covering panel having a crotch area connecting edge and an upper edge including a partial waistband having first and second terminal ends secured to and extending from the crotch area over the front area to the waistband and extending horizontally substantially across the front area to cover approximately one-half the circumference of the wearer, the front covering panel being secured to the crotch area along the crotch area connecting edge and extending therefrom along the leg openings to a location between the front and back areas and then upwardly therefrom proximate the front waistband thereby forming a separate layer of fabric extending across approximately one-half the circumference of the wearer and a genital-receiving pocket between the front area and the front covering panel; a partial waistband retaining the upper edge of the front covering panel in a first unsecured contiguous relationship with the front waistband and permitting biased displacement of the upper edge of the front covering panel to allow access to the pocket whereby the wearer is provided with an absorbent fabric layer functioning also to protect from rashes and reduce scrotal temperature wherein the partial waistband is secured to the genital covering panel and to the front and back waistband and the partial waistband terminal ends are extended in the forwardly condition, wherein the front covering panel has a convex pouch portion, a plurality of joined sections, and the joined front covering panel and each of the leg openings are connected and finished by stretchable leg band encircling each leg opening.

2. The undergarment as claimed in claim 1 wherein the front covering panel is formed of polyester plain knit fabric having a plurality of courses and a plurality of wales, and laid-in elastomeric yarn in selected plain knit fabric courses.

3. The undergarment as claimed in claim 1 wherein the front covering panel includes 88 to 92% polyester plain knit yarn and from 8 to 12% elastomeric laid-in yarn.

4. The undergarment as claimed in claim 1 wherein the front covering panel is formed of plain knit polyester yarn.

5. The undergarment as claimed in claim 1 wherein the front covering panel is formed of plain knit cotton yarn.

6. The undergarment as claimed in claim 2 wherein the joined front covering panel in each of the leg openings is connected and finished by a stretchable leg band encircling each leg opening.

7. The undergarment as claimed in claim 3 wherein the front covering panel is formed of plain knit cotton yarn.

8. The undergarment as claimed in claim 2 wherein the elastomeric yarn is laid in in every course.

9. The undergarment as claimed in claim 8 wherein the front covering panel has a convex pouch portion and the joined front covering panel and each of the leg openings is connected and finished by a stretchable leg band encircling each leg opening.

* * * * *